United States Patent [19]

Murase

[11] 4,305,994

[45] Dec. 15, 1981

[54] PROCESS FOR FORMING MULTILAYER COATING

[75] Inventor: Heihachi Murase, Hiratsuka, Japan

[73] Assignee: Kansai Paint Co., Ltd., Japan

[21] Appl. No.: 177,509

[22] Filed: Aug. 12, 1980

[30] Foreign Application Priority Data

Aug. 17, 1979 [JP] Japan ..... 54/103982

[51] Int. Cl.[3] ..... B05D 1/36

[52] U.S. Cl. ..... 428/411; 525/117; 525/119; 426/418; 426/458; 426/457; 427/407.1; 427/409; 427/410; 427/388.1

[58] Field of Search ..... 428/418, 411, 458, 457; 427/407.1, 409, 410, 388.1, 386

[56] References Cited

FOREIGN PATENT DOCUMENTS 52-43839 4/1977 Japan .
53-14577 4/1978 Japan .
55-118973 12/1980 Japan .

*Primary Examiner*—Sam Silverberg

*Attorney, Agent, or Firm*—Wenderoth, Lind & Ponack

[57] ABSTRACT

In a process for forming a multilayer coated film which comprises coating a multilayer coat-forming paint on the surface of a substrate to form a multilayer coated film thereon, the improvement wherein prior to the coating, the surface of the substrate is treated with a solution containing at least one onium compound selected from compounds of formulae (I) and (II) below (I) (II)

wherein Y represents a nitrogen, phosphorus or arsenic atom, $R_1$, $R_2$, $R_3$ and $R_4$ are identical or different and each represents a hydrogen atom or an organic group having not more than 8 carbon atoms, and $X_\ominus$ represents an anion.

13 Claims, 2 Drawing Figures

PROCESS FOR FORMING MULTILAYER COATING

This invention relates to a process for forming a multilayer coating. More specifically, this invention relates to a process for pre-treating the surface of a substrate before coating a paint capable of forming a multi-layer coating, which comprises pre-treating said surface with a certain kind of onium compound thereby to promote phase separation of the paint (formation of multilayers), increase the surface smoothness of the formed multilayer coating, and also improve the properties of the coating.

Multilayer-forming paints form a multilayer coating capable of exhibiting the dual function of a primer and a top coat by one coating and baking. Such a type of paint is generally composed of a resin having relatively strong polarity such as an epoxy resin or polyester resin and a resin having relatively low polarity such as a polyolefin resin or acrylic resin. When this paint is coated on the surface of a substrate, the aforesaid resin components adhere randomly to the substrate surface. But when it is baked subsequently, the resin components are melted whereby the resin component of high polarity moves to the surface of the substrate, and the resin component of low polarity moves toward the outside air to form a multilayer coating. Subsequently, the curing of the coating proceeds to give a firm multilayer coating. In order to distribute two or more resin components in the multilayer coat-forming paint distinctly into a multiplicity of layers at the time of baking, it may be possible to utilize the surface tensions of these resin components during melting, a multilayer-forming parameter, and an affinity parameter. The theory of this is already known to those skilled in the art. The multilayer coat-forming paints and the theory of forming films therefrom are described, for example, in Japanese Pat. No. 14577/78.

Multilayer coat-forming paints having the above function are known, and some have already been suggested for commercial application. Typical examples are described in Japanese Pat. No. 14577/78 and Japanese Laid-Open Pat. Nos. 43839/77 (corresponding to British Pat. No. 1,570,540) 140336/78 and 118,973/80. The multilayer coat-forming powder paints disclosed in these patent documents are composed of a mixture of two or more polymers having different properties (e.g., compatibility, surface tension). Such a powder paint is characterized by the fact that it can afford by one coating and one baking a multilayer coated film having a combination of desirable properties, such as good adhesion to the substrate surface, good corrosion resistance, and good weatherability and stain resistance on that surface of the coated film which is in contact with the air. Because of this advantage, these paints have attracted great attention in the art as energy-saving paints.

These paints have shortcomings, too. Since the mechanism of forming a multilayer coated film is based on the utilization of the difference in surface energy between the polymer in the paint and the substrate surface i.e. the utilization of the natural law of energy, increasing factors which impair it lead to an imperfect multilayer film. Formation of a multilayer coated film is due to the difference in surface energy between the film-forming components. Since this difference is far larger than the difference in specific gravity between the individual polymers or the difference in specific gravity between the pigments, no trouble occurs in this regard. But serious problems arise in trying to form a complete multilayer coating in a system involving a high rate of curing reaction, a highly viscous system, a thin film system or on a substrate surface having a low surface energy.

In a general coating process, it is often the practice to increase the crosslinking density of polymer in order to impart physical strength to the coated film. This means the increasing of curability, and consequently, the gel time of the paint is shortened. This is also the case with the formation of a multilayer film. Where a coated film having high physical strength is desired, a high crosslinking density and shortening of the gel time are naturally required. The flowable condition of a paint necessary for formation of a multilayer coating cannot be retained for a sufficiently extended period of time, and a non-uniform multilayer film often results.

Similar results are noted in forming a multilayer coated film in a highly viscous system. For example, in the case of a multilayer coat-forming paint comprising a polyolefin and an epoxy resin, phase separation and formation of a multilayer film are often incomplete because of the poor flowability of the polyolefin. The incomplete formation of a multilayer film in this case is evaluated in terms of appearance and performance. Microscopic observation of the coated film shows that a component forming a layer in contact with the substrate surface (to be referred to as a "lower layer component") cannot uniformly cover the substrate surface, and a component forming a layer in contact with the air (to be referred to as "an upper layer component") sometimes makes contact with the substrate surface. As a result, the interface between the layers is not flat, and a complete multilayer film is difficult to form. If the lower layer component is an anticorrosive paint in this case, it is evident that its corrosion resistance is naturally reduced. Furthermore, when such an uneven interface occurs in the multilayer coating, it also adversely affects the smoothness of the topmost surface of the coated film and its gloss is evidently deteriorated.

As stated above, the multilayer coat-forming paint can give a satisfactory multilayer coated film if its flowability required for formation of a multilayer coated film can be retained for a sufficiently extended period of time and it has a melt viscosity sufficient for it to be flowable. Otherwise, the resulting multilayer coated film tends to be imperfect.

On extensive investigations, we have now found that when the surface of a substrate is pre-treated with a certain kind of onium compound before coating it with a multilayer coat-forming paint, formation of a multilayer coated film is promoted and proceeds smoothly and rapidly even under conditions not entirely suitable for formation of a multilayer coating, for example when the flowability of a multilayer coat-forming paint can be retained only for a short period of time or when the paint contains a resin component having a high melt viscosity; and that as a result, a multilayer coated film which is perfect both in appearance and performance can be formed from the paint.

Thus, according to this invention, there is provided a process for forming a multilayer coated film which comprises coating a multilayer coat-forming paint on the surface of a substrate to form a multilayer coated film thereon, characterized in that prior to the coating, the surface of the substrate is treated with a solution containing at least one onium compound selected from compounds of formulae (I) and (II) below

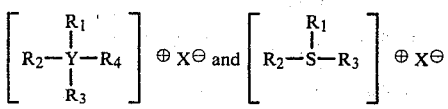

(I) (II)

wherein Y represents a nitrogen, phosphorus or arsenic atom, $R_1$, $R_2$, $R_3$ and $R_4$ are identical or different and each represents a hydrogen atom or an organic group having not more than 8 carbon atoms, and $X^{\ominus}$ represents an anion.

According to the process of this invention, the surface of a substrate is pre-treated with the onium compound of formula (I) or (II) to form a very thin film, one to several molecules thick, of the onium compound thereon. When a multilayer coat-forming paint is applied to the pre-treated substrate surface, the lower layer component of the paint uniformly wets the substrate surface within a very short period of time, and the upper layer component exclusively forms an upper layer without adhering to the substrate surface. Hence, it is possible to form a perfect multilayer film composed of the lower and upper layers which are superimposed parallel to each other.

The onium compounds used in the process of this invention have strong affinity both for the substrate surface (for example, the surface of a metal, or a chemically treated surface of a metal) and the lower layer component (e.g., epoxy or polyester resin) of the multilayer coat-forming paint. It is believed that the onium compounds cause smooth "wetting" between the substrate surface and the lower layer resin component of the multilayer coat-forming paint in the film-forming process, and consequently, phase separation is completed with a very short period of time to give a smooth multilayer coated film. This has an effect of performing formation of a multilayer coated film easily when the reactivity of the film-forming components, especially the upper layer resin component, is increased in order to improve film properties, formation of a multilayer coated film under conditions such that the flowability lasting-gellation time is shortened, formation of a multilayer coated film at high temperatures for a short period of time, or formation of a multilayer coated film in a system which comprises a resin composition of a high melt viscosity such as the aforesaid polyolefin/epoxy resin system. It has also been confirmed that the process of this invention is very effective for forming an ultrathin multilayer film (20 to 30 microns) the formation of which is considered very difficult with the use of a powdery multilayer coat-forming paint.

Thus, the process of this invention serves to make up for the non-conformity of various factors involved in the formation of a multilayer coated film, and can give a multilayer coated film which is perfect both in appearance and in function.

Moreover, according to the process of this invention, the surface energy of the surface of a substrate can be effectively controlled by the pre-treatment of the substrate surface with the specified onium compounds. Thermodynamic interaction between the lower layer component of a multilayer coat-forming paint and the surface of a substrate is one important factor in the mechanism of forming a multilayer coated film form the paint (phase separation). When the surface energy of the substrate surface is lower than that of the lower layer resin component, the formation of the desired multilayer coated film is extremely difficult. If the pretreating process in accordance with this invention is applied to such a substrate surface, the surface energy level of the substrate surface can be greatly improved, and a multilayer coated film can be very easily formed on the substrate surface.

By using the pre-treating process of this invention, outstanding advantages can be obtained in the multilayer coat-formability of the multilayer coat-forming paints. As a result, the appearance of the multilayer coated film, the adhesion to the substrate surface and corrosion resistance of the lower layer of the film, and the weatherability and soiling resistance of the upper layer of the coated film can be independently exhibited. In this regard, too, the present invention has very great industrial significance.

In formulae (I) and (II) above, the organic group for $R_1$, $R_2$, $R_3$ and $R_4$ may be any organic group which does not substantially hamper the ionization of the onium compounds and does not adversely affect the affinity of the onium compounds for the substrate surface. The organic group generally includes hydrocarbon groups having not more than 8 carbon atoms, preferably not more than 7 carbon atoms, which may contain a hetero atom such as an oxygen atom in the form of the hydroxyl group, alkoxy group (i.e., etheric oxygen), etc., and/or may be substituted by a halogen atom. Thus, the organic group may be a hydrocarbon group having not more than 8 carbon atoms, preferably not more than 7 carbon atoms, which may optionally contain at least one, preferably 1 to 3, more preferably only one, hetero atom selected from hydroxylic and etheric oxygen atoms and halogen atoms. Such hydrocarbon groups include aliphatic, alicyclic and aromatic hydrocarbon groups such as alkyl, cycloalkyl, cycloalkyl-alkyl, aryl and aralkyl groups. The alkyl groups may be linear or branched, and desirably have 1 to 6 carbon atoms, such as methyl, ethyl, n- or iso-propyl, n-, iso-, sec- or tert-butyl, pentyl, heptyl, and octyl. The cycloalkyl and cycloalkyl-alkyl groups are preferably those having 5 to 8 carbon atoms such as cyclopentyl, cyclohexyl, cyclohexylmethyl, and cyclohexylethyl. Examples of the aryl groups include phenyl, tolyl, and xylyl, the phenyl group being preferred. Examples of the aralkyl groups are benzyl and phenethyl groups, the benzyl group being preferred.

Preferred examples of the hydrocarbon group containing a hetero atom selected from hydroxylic and etheric oxygen atoms and halogen atoms include $C_1$–$C_8$ hydroxyalkyl groups (especially hydroxy lower alkyl groups) such as hydroxymethyl, hydroxyethyl, hydroxybutyl, hydroxypentyl, hydroxyheptyl and hydroxyoctyl; $C_2$–$C_8$ alkoxyalkyl groups (especially lower alkoxy lower alkyl groups) such as methoxymethyl, methoxyethyl, ethoxymethyl, n-propoxyethyl, iso-propoxymethyl, n-butoxymethyl, iso-butoxyethyl, and tert-butoxyethyl; and $C_1$–$C_6$ alkyl groups such as chloromethyl, chloroethyl, chloropropane, chloropentane, bromoethyl and bromopropane.

Examples of the anion $X^{\ominus}$ are inorganic acid radicals such as $PO_4^{3\ominus}$, $HPO_4^{2\ominus}$, $H_2PO_4^{\ominus}$, halogen ions (e.g., $Cl^{\ominus}$, $Br^{\ominus}$, $I^{\ominus}$), $SO_4^{2\ominus}$, $HSO_4^{\ominus}$ and $NO_3^{\ominus}$ hydroxyl ion ($OH^-$); and organic acid radicals such as $CH_3COO^{\ominus}$, $C_2H_5COO^{\ominus}$, $CH_3CH(OH)COO^{\ominus}$, and $C_6H_5SO_3^{\ominus}$.

The term "lower" used in the present application to qualify groups or compounds means that groups and compounds so qualified have not more than 6 carbon atoms, especially not more than 4 carbon atoms.

Typical examples of the onium compounds of formulae (I) and (II) are listed below.

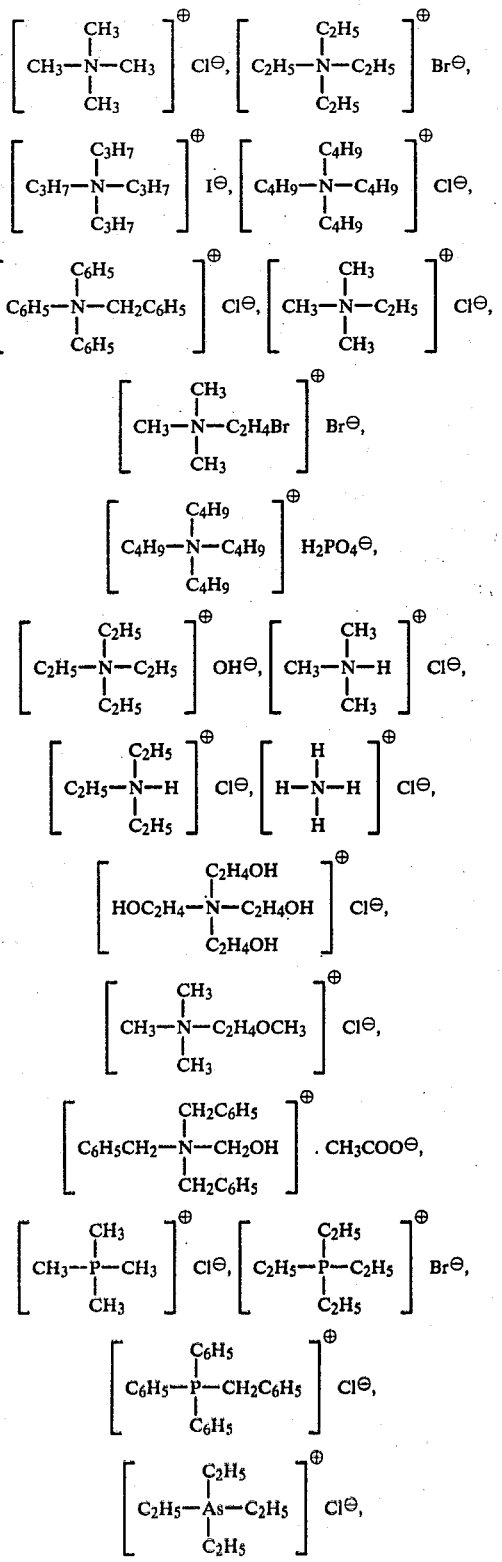

-continued

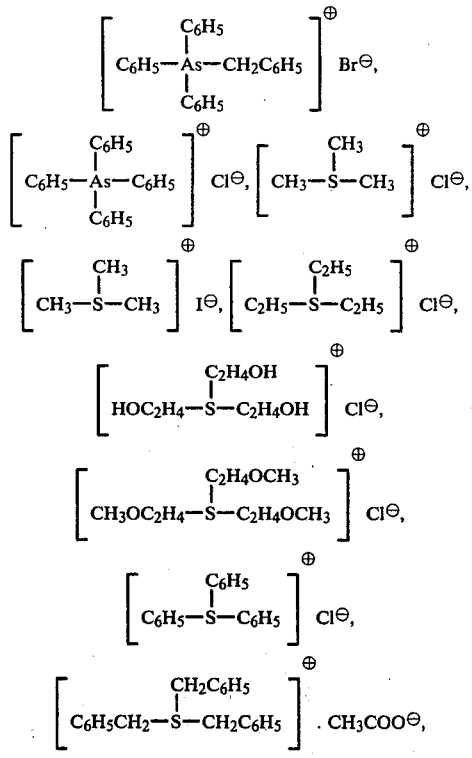

These onium compounds can be used either singly or in combination with each other.

Since the onium compound has the property of imparting thermodynamic affinity between the substrate surface and the lower layer component of the multilayer coat-forming resin, even a very small amount of a thin film, one to several molecules thick, of the onium compound can exert a great action on the formation of the multilayer coating. The action of the alkyl groups as substituents $R_1$ to $R_4$ is the greatest with lower alkyl groups, especially methyl, and tends to become progressively weak as the number of carbon atoms of the alkyl groups increases. The effect is large in the case of aryl and aralkyl groups such as a phenyl or benzyl group. Accordingly, the substituents $R_1$ to $R_4$ are preferably $C_1$–$C_4$ alkyl groups, $C_1$–$C_4$ hydroxyalkyl groups, $C_2$–$C_4$ alkoxyalkyl groups, $C_1$–$C_4$ haloalkyl groups, a phenyl group and a benzyl group.

As regards the central elements of the onium compounds, a nitrogen atom and a phosphorus atoms are especially suitable, and arsenic and sulfur atoms seem to decrease slightly in effect.

As regards the anions $X^{\ominus}$, halogen ions, especially chlorine ion, are most suitable, and next come a bromine ion and an iodine ion.

A preferred group of onium compounds for use in this invention, therefore, includes ammonium and phosphonium compounds of the following formula

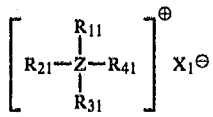

(III)

wherein Z represents a nitrogen or phosphorus atom, $R_{11}$, $R_{21}$, $R_{31}$ and $R_{41}$ are identical or different, and each represents a lower alkyl group having 1 to 4 carbon atoms (especially a methyl or ethyl group), a hydroxyalkyl group having 1 to 4 carbon atoms, an alkoxyalkyl group having 2 to 4 carbon atoms, a haloalkyl group having 1 to 4 carbon atoms, a phenyl group or a benzyl group, and $X_1^{\ominus}$ represents a halogen ion, especially $Cl^{\ominus}$, $Br^{\ominus}$ or $I^{\ominus}$.

In treating the surface of a substrate, the onium compound is applied from its solution.

Since the onium compound is generally water-soluble, it can be used as an aqueous solution. Any other solvent which is capable of dissolving the onium compound may be used because a multilayer coat-forming paint is usually applied after the pre-treating onium compound coating has been dried up, and the type of the solvent of the pre-treating solution does not affect the film formability of the multilayer coat-forming paint. An organic solvent can thus be used in order to improve the drying property of the pre-treating solution or the wettability of the substrate surface, and a mixture of water and a water-miscible organic solvent may also be used. Examples of the organic solvent that can be used include ketones such as acetone, methyl ethyl ketone and methyl isobutyl ketone, alcohols such as methanol, ethanol and isopropanol, esters such as methyl acetate, ethyl acetate and isopropyl acetate, and high-boiling solvents such as ethylene glycol monoethyl ether and ethylene glycol monoethyl ether acetate. These solvents may be used singly or as a mixture with each other. Or at least one of them may be used in combination with water. Which solvent or solvent mixture is to be used is determined by considering the solubility of the onium compound, the wettability of the substrate surface, the drying property of the onium compound, the risk of ignition of the solvent and its effect on the working environment, etc.

The concentration of the onium compound in the solvent is not critical. It is generally 0.01 to 30% by weight, preferably 0.3 to 5% by weight. If the concentration of the onium compound is less than 0.01% by weight, the pre-treating effect is generally reduced, and the lower layer component cannot completely cover the surface of the substrate. If, on the other hand, it exceeds 30% by weight, the pre-treating solution of the onium compound becomes viscous, and its coatability is reduced. Moreover, its drying property is aggravated.

Application of the pre-treating solution so prepared containing at least one such onium compound can be effected by known coating methods such as spray coating, brush coating, roller coating and dip coating. The amount of the pre-treating solution differs depending upon the type or concentration of the onium compound used. Advantageously, it is generally about 0.001 to about 1.5 g/m$^2$, preferably about 0.01 to about 0.5 g/m$^2$, calculated as the weight of the onium compound in the pre-treating solution.

Drying of the coated pre-treating solution may be effected at room temperature or at an elevated temperature. It is only sufficient to evaporate the solvent. When the pre-treating solution has a high content of water, its evaporation is slow, and generally the drying is carried out at an elevated temperature. Suitably, the drying is carried out in a heated oven through which hot air is circulated. The drying temperature is desirably set at 50° to 140° C.

The drying time is not specifically limited because the ultimate purpose is to evaporate the solvent. In the case of drying at room temperature, the sufficient drying time is 5 to 15 minutes, and at 100° C., a period of 2 to 3 minutes are sufficient.

If desired, about 0.1 to about 3 parts by weight of a mon-, di- or tri-(hydroxy lower alkyl) amine such as monoethanolamine, diethanolamine, triethanolamine or about 0.05 to about 0.2 part of phosphoric acid, per 100 parts by weight of the treating solution, may be added to the pre-treating solution of the onium compound. This leads to improvement of corrosion resistance.

A multilayer coat-forming paint is then coated on the substrate surface which has been pre-treated with the onium compound solution in the manner described hereinabove. The subject matter of the present invention is the pre-treatment of the substrate surface with the onium compound, and there is no restriction on the type of the multilayer coat-forming paint to be subsequently coated on the pre-treated surface. Thus, any known types of multilayer coat-forming paint can be used in this invention. For example, such paints are disclosed in Japanese Pat. No. 14577/78, British Pat. No. 1,570,540, and Japanese Laid-Open Pat. Nos. 43840/77, 43841/77, 140336/78, 141341/78, 143630/78 and 25637/79. These patent documents are cited herein instead of describing these paints in detail.

The multilayer coat-forming paint is composed of a polymer component forming a lower layer and a polymer component forming an upper layer. More specifically, it may be composed of a combination of two or more thermoplastic resins of different properties (e.g., a combination of phthalic acid resin and a cellulose acetate butyrate resin), a combination of a thermosetting resin and a thermoplastic resin (e.g., a combination of an epoxy resin and a polyethylene resin), and a combination of two or more thermosetting resins having different properties (e.g., a combination of an epoxy resin and an acrylic resin having a reactive functional group). The paint may be in any form such as a powder, slurry, aqueous dispersion or aqueous solution or be solvent-based.

The multilayer coat-forming paint that can be used in this invention is prepared by using the various combinations of resins as exemplified above if at least two kinds of resins used as vehicles are insoluble or sparingly soluble in each other, and the difference in surface tension between the resins is at least 0.6 dyne/cm and the difference in multilayer forming parameter between the resins is at least 0.2 mm. Examples of the multilayer coat-forming paint meeting such requirements are a powdery multilayer coat-forming paint comprising (a) a solid powder comprising an olefinic resin containing at least 76% by weight of a structural unit derived from an olefin and having a melt index of from 0.3 to 120 g/10 min., and (b) a film-forming resin material containing an epoxy resin having a number average molecular weight of about 300 to about 4,000 and an epoxy equivalent of from 100 to 3,300, and a slurry-like multilayer coat-forming paint comprising (a) and (b) above and a volatile organic liquid medium capable of wetting said powder (a) but substantially incapable of swelling and dissolving said solid powder (a). Coating and baking of the paint can be performed by known methods or similar methods depending upon the type of the paint used.

Thus, according to the process of this invention, a multilayer coated film which is excellent both in appearance and in performance can be formed easily irrespective of the type of the multilayer coat-forming paint or the film-forming conditions.

The process of forming the multilayer coated film in accordance with the process of this invention can be well explained by the accompanying drawings which schematically show application of the multilayer coat-forming paint and the state of forming the multilayer film.

Figure 1:
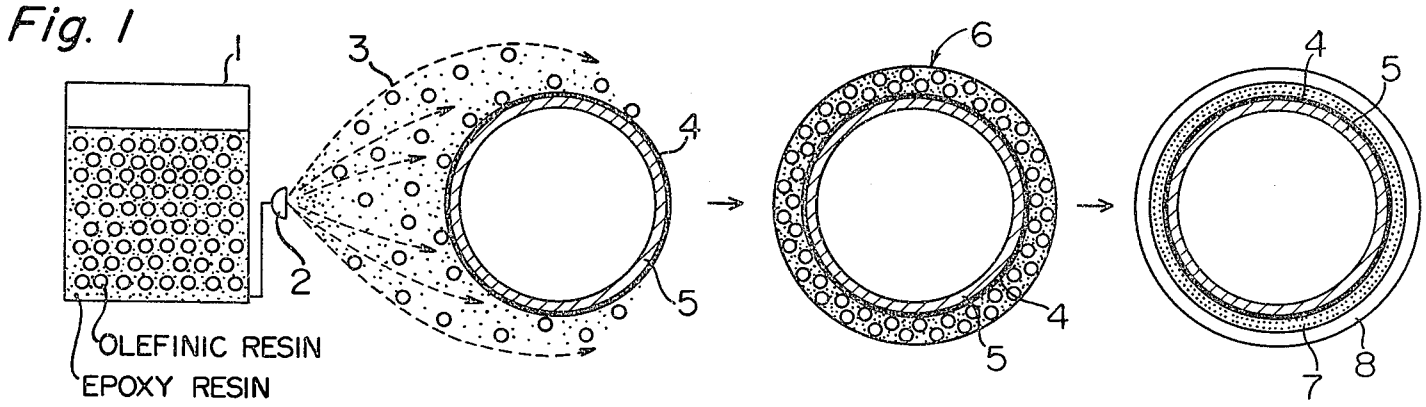
FIG. 1 is a view showing the coating process using a slurry-like multilayer coat-forming paint. The paint, as illustrated, may be prepared by dispersing a solid powder containing an olefinic resin being substantially insoluble in a solvent in a solution of an epoxy resin completely dissolved in the above solvent.
Figure 2:
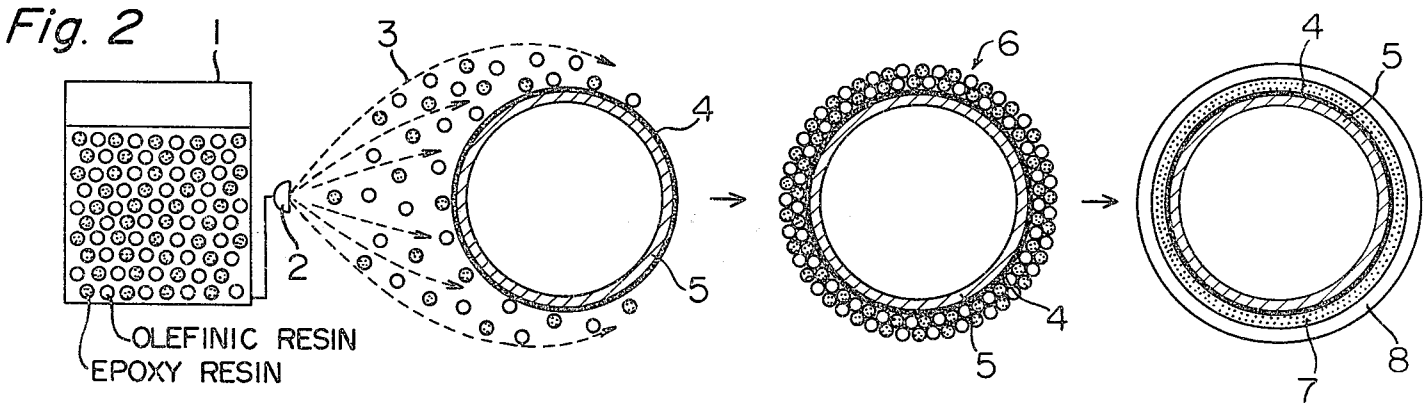
FIG. 2 is a view showing the coating process using a powdery multilayer coat-forming paint. The paint, as illustrated, may be prepared by dispersing a solid powder substantially containing an epoxy resin and a solid powder containing an olefinic resin in a liquid medium which does not substantially dissolve these solid powders.

In both of FIGS. 1 and 2, the paint 3 is fed from a supply tank 1 to a coater 2, and is then coated by the coater 2 on a metal substrate 5 having a preformed coating 4 of an onium compound in accordance with this invention, by, for example, an electrostatic coating method [step (A)]. As a result, as shown in step (B) in FIGS. 1 and 2, a single coated layer 6, which contains both the epoxy resin and the olefinic resin in a state such that the solid powder containing the olefinic resin is dispersed in the epoxy resin matrix or the solid powder containing the epoxy resin and the solid powder containing the olefinic resin are randomly mixed, is deposited on the coating 4 of the onium compound. Then, this coated layer is baked, for example by heating it at 180° C. for 30 minutes to melt the resins. As a result, the epoxy resin having high affinity for the onium compound and a high surface energy is oriented toward the substrate surface, i.e. as a lower layer and the olefinic resin having a low surface energy is oriented toward the surface of the single coated layer 6, whereby a multilayer coated film composed of a lower layer 7 of the epoxy resin and an upper layer 8 of the olefin resin is formed [step (C)].

In order to ascertain the effect of the pretreatment in accordance with this invention, it is possible to disperse different pigments in the upper and lower layer-forming components of the paint, pulling the resulting layer from the substrate either physically or by a mercury amalgam method, microscopically observing the separating condition of the individual layer-forming components at the surface contacting the substrate by the aid of the colors of the pigments. If the multilayer film formed is perfect, the coloring agent in the upper layer-forming component does not move to the surface of the substrate, and the substrate surface is completely covered with the coloring agent in the lower layer. This can also be ascertained by cutting the multilayer coated film at its perpendicular section by a microtome, and microscopically observing the cross-section of the coated film. If the multilayer coated film is perfect, the interface between the upper layer and the lower layer can be viewed as a nearly completely smooth flat surface. If, however, it is imperfect, the interface is uneven and extremely non-uniform. In this case, the top surface of the coated film is also uneven.

The process of this invention described hereinabove can be applied without restrictions to the coating of general machinery and articles used both indoors and outdoors. It can be especially suitably applied to the finish coating of articles used outdoors which require weatherability and corrosion resistance (e.g., tractors, containers, guard rails, fences, etc.), and of the insides of steel pipes or tanks which require water resistance, soiling resistance and corrosion resistance.

The following Examples illustrate the present invention more specifically. All parts and percentages are by weight.

EXAMPLE 1

A 0.5 mm thick rolled mild steel sheet was surface-treated by dipping it in a 0.5% aqueous solution of trimethyl2-bromoethyl ammonium bromide (special reagent grade, a product of Wako Pure Chemical Co. Ltd.) (the amount of the onium compound coated was 0.05 g/m$^2$). The surface coating was dried at room temperature for 10 minutes, and a multilayer coat-forming paint was electrostatically coated on the pre-treated surface. The paint used was a powder paint prepared by dry-blending (A) 60 parts of a powder resin composed of Dianal BR105 (molecular weight 51000; a thermoplastic acrylic resin made by Mitsubishi Rayon Co., Ltd.) and dispersed therein 10% of rutile type titanium white and 5% of Cyanine Green 6YS and (B) 40 parts of a powder resin composed of Epikote 1007 (containing 4.5% of dicyandiamide; an epoxy resin made by Shell Chemical Co.) and 20% of red iron oxide dispersed therein, and classifying the blend to a particle size of 74 microns.

The electrostatically coated film was heated at 180° C. for 30 minutes to form a multilayer coated film having a thickness of about 120 microns.

The resulting multilayer coated film was compared with a multilayer coated film formed under the same conditions as above except that the steel sheet was not pretreated. It was ascertained that the former was evidently better than the latter in regard to surface smoothness and gloss. The resulting multilayer film was peeled off from the steel sheet, and the separated condition of the multilayers at the substrate contacting surface was microscopically observed. It was found that while the epoxy resin layer uniformly covers the substrate surface in the former, the epoxy resin layer cannot completely cover the substrate surface in the latter and the acrylic resin layer is exposed in spots. Thus, it has been demonstrated that the pre-treating process of this invention is very effective for the formation of a multilayer film.

EXAMPLE 2

Tetraethyl ammonium hydroxide (special reagent grade, a product of Wako Pure Chemical Co., Ltd.) was dissolved in a concentration of 1% in a mixture of 80 parts of water and 20 parts of isopropanol to prepare a treating solution. A zinc phosphate-treated mild steel sheet was dipped once in the treating solution, and dried for 2 minutes in a hot air drying oven at 120° C. (the amount of the onium compound coated was 0.07 g/m$^2$). Then, a multilayer coat-forming powder paint was electrostatically coated on the pre-treated surface, and heated at 180° C. for 30 minutes to form a multilayer coated film. The multilayer coat-forming paint used was prepared by dryblending equal amounts of (A) a powder having a particle diameter of not more than 74 microns and composed of 16 parts of dodecanedioic acid and 100 parts of an acrylic resin having a number average molecular weight of 15000 and obtained by copolymerizing 9% methyl methacrylate, 13% styrene, 19% 2-ethylhexyl acrylate, 39% n-butyl methacrylate and 20% glycidyl methacrylate and (B) a powder composed of 100 parts of Epikote 1007 (an epoxy resin made by Shell Chemical Co.), 13 parts of trimellitic anhydride and 25 parts of rutile type titanium white.

The resulting multilayer coated film was compared with a multilayer coated film prepared by the same procedure as above except that the steel sheet was not pre-treated. A clear pre-treating effect was noted in the former in regard to surface smoothness and the covering of the substrate surface by the epoxy resin component.

EXAMPLE 3

Trimethyl sulfonium iodide (special reagent grade, a product of Aldrich Chemical Co.) was dissolved in a concentration of 3% in a mixture of 50 parts of water and 50 parts of methyl ethyl ketone to prepare a treating solution. A 0.8 mm-thick zinc phosphate-treated aluminum sheet (Bt-712, a product of Nippon Test Panel, Co.) was spray coated with the treating solution (the amount of the onium compound coated was 0.1 g/m$^2$). The coating was dried at 80° C. for 5 minutes, and a multilayer coat-forming powder paint was coated on the pre-treated surface, and heated at 170° C. for 30 minutes to form a multilayer coated film having a thickness of about 80 microns.

The multilayer coat-forming powder paint used was prepared by dry-blending (A) 55 parts of a powdery resin which was obtained by mixing 100 parts by weight of an acrylic resin having a number average molecular weight of 16000 and obtained by copolymerizing 18% styrene, 20% methyl methacrylate, 33% isobutyl methacrylate, 9% 2-ethylhexyl methacrylate and 20% 2-hydroxyethyl methacrylate with 25 parts of a blocked isocyanate curing agent (isophorone diisocyanate blocked with epsiloncaprolactam; NCO content 13.8%), pulverizing the mixture, dispersing the particles by a hot roll and then further pulverizing them, and classifying them to a particle size of not more than 74 microns, with (B) 45 parts of a powdery resin which was obtained by mixing 100 parts of a polyester resin having a number average molecular weight of 7200 and obtained by polycondensing 29.0% dimethyl terephthalate, 17.0% isophthalic acid, 4.3% adipic acid, 45.0% neopentyl glycol and 4.7% glycerol, 25 parts of blocked isocyanate curing agent (xylylene diisocyanate blocked with epsilon-caprolactam; NCO content 19.7%) and 15 parts of a rustproof pigment (Rustack 450, a product of Toda Kogyo K.K.), and working up the mixture in the same way as in the preparation of the resin (A).

The multilayer coated film was peeled off from the steel sheet, and its cross section was compared with that of a multilayer coated film formed by the same procedure as above except that the substrate surface was not pre-treated. It was found that in the former, the interface between the upper layer and the lower layer formed a complete horizontal surface, but in the latter, the interface was considerably uneven.

EXAMPLE 4

Triphenylbenzyl phosphonium chloride (special reagent grade; a product of Wako Pure Chemical Co., Ltd.) was dissolved in a concentration of 1% in a mixture of 90 parts of water and 10 parts of isopropanol to prepare a treating solution. A rolled mild steel sheet was pretreated with the treating solution in the same way as in Example 1 (the amount of the onium compound coated: 0.04 g/m$^2$). A nonaqueous slurry-like multilayer coat-forming paint was coated on the pre-treated surface of the steel sheet, and heated at 200° C. for 20 minutes to form a multilayer coated film having a thickness of about 30 microns.

The non-aqueous slurry-like multilayer coatforming paint was prepared by dispersing 50 parts of a low-density polyethylene powder (FLO-Thene UF 1.5, a product of Seitetsu Chemical Industry Co. Ltd.) having a melt index of 1.5 g/10 min. and an average particle diameter of 25 microns and 50 parts of a powdery epoxy resin composition having an average particle diameter of 25 microns and composed of 100 parts of a bisphenol A-type epoxy resin having a number average molecular weight of 3750 and an epoxy equivalent of 2850 (Epikote 1009, a product of Shell Chemical Co.,), 5.5 parts of adipic acid dihydrazide and 20 parts by weight of red iron oxide in 150 parts of a solvent composed of 65% of iso-octane and 35% of ethylcyclohexane.

The resulting multilayer coated film was compared with a multilayer coated film formed by the same procedure as above except that the substrate surface was not pre-treated. The former had a completely smooth flat surface, and the epoxy layer uniformly covered the surface of the steel sheet. In contrast, the surface of the latter coated film was uneven. Hence, the epoxy resin layer could not completely cover the surface of the substrate, and the polyethylene layer was exposed in spots onto the substrate surface. It has been ascertained therefore that by the pre-treating method of this invention a perfect multilayer coated film can be obtained.

EXAMPLE 5

Tetraphenyl arsonium chloride (reagent grade 1, a product of Aldrich Chemical Co.) was dissolved in water to form a 0.5% aqueous solution. A zinc phosphate-treated mild steel sheet was dipped in the aqueous solution, and dried at 140° C. for 3 minutes to pre-treat it (the amount of the onium compound coated was 0.02 g/m$^2$). A multilayer coat-forming paint was coated on the pre-treated surface of the steel sheet, and heated at 200° C. for 15 minutes to form a multilayer coated film having a thickness of about 25 microns.

The paint used was a slurry-type coating composition prepared by dispersing 50 parts of a powdery ethylene/vinyl acetate copolymer powder (Evaflex #360, a product of Mitsui Polychemical Co., Ltd.) having a melt index of 2 g/10 min. and a partcle size distribution of 5 to 15 microns and 50 parts of an epoxy resin composition having a particle size distribution of 5 to 40 microns and containing a bisphenol A-type epoxy resin having a number average molecular weight of 2900 and an epoxy equivalent of 1900 (Epikote 1007) and dicyandiamide in a weight ratio of 100:4.5 in 180 parts of n-octane.

The resulting multilayer coated film was compared with a multilayer coated film formed by the above procedure except that the substrate surface was not pretreated. It was found that the former was much better in surface smoothness and the covering of the substrate surface by the lower layer. Hence, a clear pretreating effect was noted.

What we claim is:

1. In a process for forming a multilayer coated film which comprises coating a multilayer coat-forming paint on the surface of a substrate to form a multilayer coated film thereon, the improvement wherein prior to the coating, the surface of the substrate is treated with a solution containing at least one onium compound selected from compounds of formulae (I) and (II) below

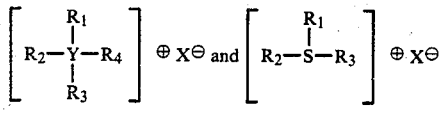

(I) (II)

wherein Y represents a nitrogen, phosphorus or arsenic atom, $R_1$,$R_2$, $R_3$ and $R_4$ are identical or different and each represents a hydrogen atom or an organic group having not more than 8 carbon atoms, and $X^{\ominus}$ represents an anion.

2. The process of claim 1 wherein said organic group is a hydrocarbon group having not more than 8 carbon atoms and containing a hetero atom selected from the group consisting of hydroxylic and etheric oxygen atoms and halogen atoms.

3. The process of claim 2 wherein said organic group is selected from the class consisting of alkyl groups having 1 to 6 carbon atoms, cycloalkyl groups having 5 to 8 carbon atoms, cycloalkyl-alkyl groups having 5 to 8 carbon atoms, a phenyl group, a toluyl group, a xylyl group, a benzyl group, hydroxyalkyl groups having 1 to 8 carbon atoms, alkoxyalkyl groups having 2 to 8 carbon atoms and haloalkyl groups having 1 to 6 carbon atoms.

4. The process of claim 3 wherein said organic group is selected from the class consisting of alkyl groups having 1 to 4 carbon atoms, hydroxyalkyl groups having 1 to 4 carbon atoms, alkoxyalkyl groups having 2 to 4 carbon atoms, haloalkyl groups having 1 to 4 carbon atoms, a phenyl group and a benzyl group.

5. The process of claim 1 wherein said anion $X^{\ominus}$ is selected from the group consisting of $PO_4^{3\ominus}$, $HPO_4^{2\ominus}$, $H_2PO_4^{\ominus}$, $SO_4^{2\ominus}$, $NO_3^{\ominus}$, $OH^{\ominus}$, $CH_3COO^{\ominus}$, $C_2H_5COO^{\ominus}$, $CH_3CH(OH)COO^{\ominus}$ and $C_6H_5SO_3^{\ominus}$.

6. The process of claim 5 wherein said anion is a halogen ion.

7. The process of claim 1 wherein said onium compound is selected from the group consisting of

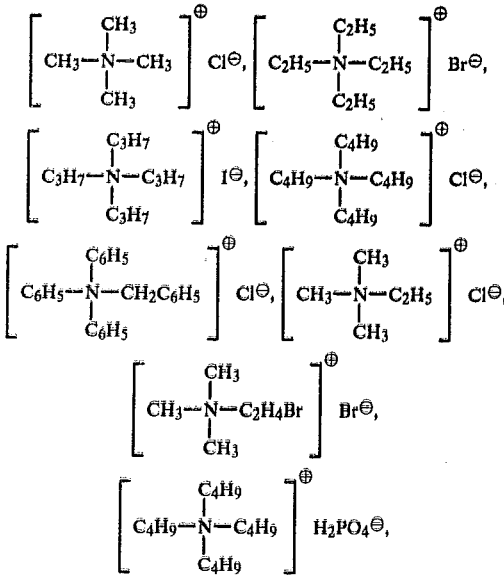

-continued

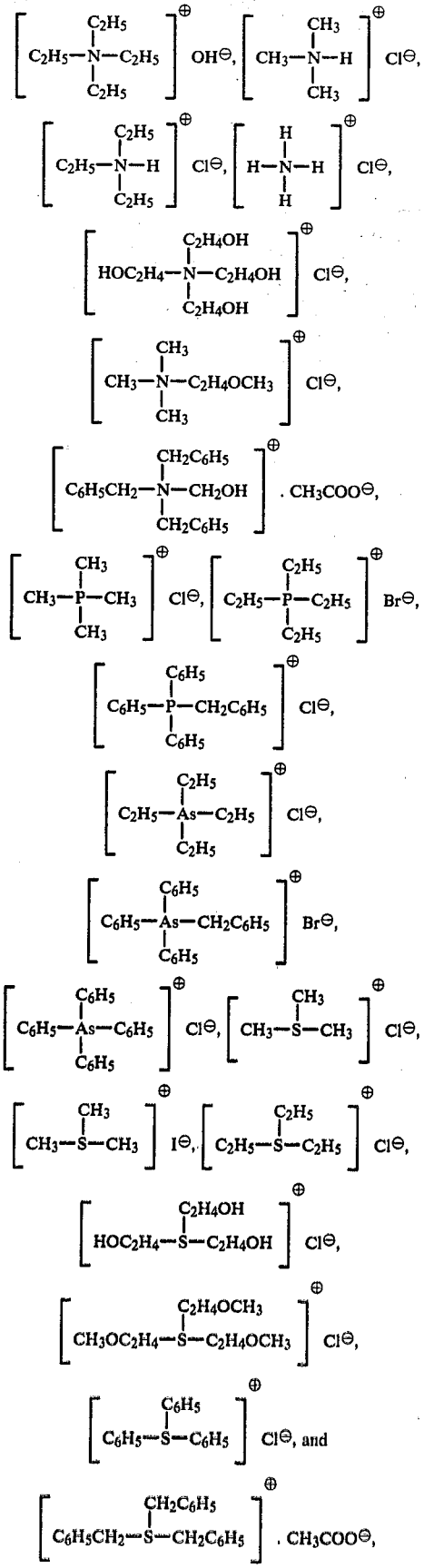

8. The compound of claim 1 wherein said onium compound is an ammonium or phosphonium compound of the following formula

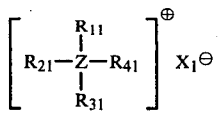

(III)

wherein Z represents a nitrogen or phosphorus atom, $R_{11}$, $R_{21}$, $R_{31}$, and $R_{41}$ are identical or different and each represents a lower alkyl group having 1 to 4 carbon atoms, a hydroxyalkyl group having 1 to 4 carbon atoms, an alkoxyalkyl group having 2 to 4 carbon atoms, a haloalkyl group having 1 to 4 carbon atoms, a phenyl group or a benzyl group, and $X_1\ominus$ represents a halogen ion.

9. The process of claim 1 wherein said solution contains said onium compound in a concentration of 0.01 to 30 % by weight.

10. The process of claim 1 wherein said treatment is effected by coating the surface of said substrate with said solution.

11. The process of claim 10 wherein said onium compound is coated at a rate of about 0.001 to about 1.5 $g/m^2$.

12. The process of claim 1 wherein said solution contains a mono-, di- or tri-(hydroxy lower alkyl)amine or phosphoric acid.

13. An article coated by the process of any one of claims 1 to 12.

* * * * *